US012729883B2

(12) United States Patent
Yuan et al.

(10) Patent No.: US 12,729,883 B2
(45) Date of Patent: Sep. 8, 2026

(54) SINGLE-WELL HEAT EXCHANGE SYSTEM AND DOWNHOLE ENHANCED HEAT EXCHANGE DEVICE OF GEOTHERMAL WELL

(71) Applicants: China Huaneng Group Clean Energy Technology Research Institute Co., Ltd, Beijing (CN); HUANENG (FUJIAN) ENERGY DEVELOPMENT CO., LTD, Fuzhou (CN)

(72) Inventors: Haowei Yuan, Beijing (CN); Tieya Jing, Beijing (CN); Lianbo Liu, Beijing (CN); Deyuan Zhao, Fuzhou (CN); Yulong Yin, Beijing (CN); Shoucheng Wei, Fuzhou (CN); Mingyu Zhu, Beijing (CN); Xiaohui Guo, Beijing (CN); Jin Zheng, Beijing (CN)

(73) Assignees: China Huaneng Group Clean Energy Technology Research Institute Co., Ltd;, Beijing (CN); HUANENG (FUJIAN) ENERGY DEVELOPMENT CO., LTD, Fuzhou (CN)

( * ) Notice: Subject to any disclaimer, the term of this patent is extended or adjusted under 35 U.S.C. 154(b) by 170 days.

(21) Appl. No.: 18/902,117

(22) Filed: Sep. 30, 2024

(65) Prior Publication Data

US 2025/0137692 A1 May 1, 2025

(30) Foreign Application Priority Data

Oct. 30, 2023 (CN) ..... 202311424076.2

(51) Int. Cl.
*F24T 10/20* (2018.01)

(52) U.S. Cl.
CPC ..... *F24T 10/20* (2018.05)

(58) Field of Classification Search
CPC ..... F24T 10/20; Y02E 10/10
See application file for complete search history.

(56) References Cited

FOREIGN PATENT DOCUMENTS

| | | | | |
|---|---|---|---|---|
| CN | 104132962 A | 11/2014 | | |
| CN | 110131782 A | 8/2019 | | |
| CN | 216644598 U | 5/2022 | | |
| WO | WO-2021145776 A1 * | 7/2021 | ..... | F24T 10/20 |
| WO | WO-2021148100 A2 * | 7/2021 | ..... | F24T 50/00 |

* cited by examiner

*Primary Examiner* — Eric S Ruppert
(74) *Attorney, Agent, or Firm* — George D. Morgan

(57) ABSTRACT

The embodiment of the present application discloses a single-well heat exchange system and a downhole enhanced heat exchange device of a geothermal well. The first main pipe communicates with an inner pipe of the single-well heat exchange device, return water entering the inner pipe sequentially enters the first main pipe and the second main pipe, part of the return water directly flows back to a geothermal reservoir, and part of the return water enters an annulus between the inner pipe and an outer casing of the single-well heat exchange device through a through hole of the second main pipe. The part, located at a target reservoir, of the retractable heat exchange pipe is used for absorbing geothermal heat of the target reservoir and transmitting the geothermal heat to an fixed end of the retractable heat exchange pipe to heat the return water entering the first main pipe.

10 Claims, 6 Drawing Sheets

SINGLE-WELL HEAT EXCHANGE SYSTEM AND DOWNHOLE ENHANCED HEAT EXCHANGE DEVICE OF GEOTHERMAL WELL

CROSS-REFERENCE TO RELATED APPLICATIONS

The application claims priority to Chinese patent application No. 2023114240762, filed on Oct. 30, 2023, the entire contents of which are incorporated herein by reference.

TECHNICAL FIELD

The present application relates to the technical field of geothermal systems, and in particular to a single-well heat exchange system and a downhole enhanced heat exchange device of a geothermal well.

BACKGROUND

Geothermal energy belongs to renewable energy, the development of geothermal energy reduces the degree of dependency on fuel energy sources, and geothermal energy has the advantage of not being affected by meteorological conditions.

In recent years, the application of geothermal energy to heating has been increased in northern areas, generally using geothermal well single-well heat exchange technology, but the return water temperature of the geothermal well single-well heat exchange technology is low, the geothermal temperature decays quickly, and it is difficult to maintain a high temperature after geothermal well exploitation.

Therefore, how to slow down the geothermal temperature decay speed of single-well heat exchange of the geothermal well to extend the service life of the geothermal well becomes a technical problem to be solved by those skilled in the art.

SUMMARY

The present application proposes a downhole enhanced heat exchange device of a geothermal well to slow down the geothermal temperature decay speed of single-well heat exchange of the geothermal well, extending the service life of the geothermal well. The present application also presents a single-well heat exchange system.

In order to achieve the above object, the present application provides a downhole enhanced heat exchange device of a geothermal well, including:

a first main pipe, an upper end of the first main pipe being able to communicate with an inner pipe of a single-well heat exchange device;

a second main pipe communicating with a lower end of the first main pipe, a pipe wall of the second main pipe being provided with a through hole communicating with an annulus between the inner pipe and an outer casing of the single-well heat exchange device; and retractable heat exchange pipes, the retractable heat exchange pipes being able to expand and contract along the radial direction of the first main pipe, a fixed end of the retractable heat exchange pipe being located in the first main pipe (1) and sealingly connected with the first main pipe, and a free end of the retractable heat exchange pipe being able to extend into a target reservoir by the annulus to absorb the heat of the target reservoir for heating return water of the inner pipe.

Preferably, in the above-mentioned downhole enhanced heat exchange device of the geothermal well, the retractable heat exchange pipe includes:

an electromagnet, located in the first main pipe;

a magnetic suction piece capable of being absorbed by the electromagnet;

a retractable pipe, including a first short pipe, a second short pipe, . . . and an nth short pipe which are successively reduced in diameter and are in inserted connection, a first end of the first short pipe is connected with the electromagnet, a second end of the first short pipe penetrates through a pipe wall of the first inner pipe and is connected with the pipe wall, a free end of the nth short pipe is provided with a sealing plate, the magnetic suction piece is arranged in the nth short pipe, and the magnetic suction piece is connected with the sealing plate, wherein n is a positive integer, $n \geq 2$; and a spring, installed inside the retractable pipe, the spring having a length at least equal to the length of the extended retractable pipe, one end of the spring being connected with the electromagnet, the other end of the spring being connected with the sealing plate.

Preferably, in the above-mentioned downhole enhanced heat exchange device of the geothermal well, the retractable pipe is a copper pipe.

Preferably, in the above-mentioned downhole enhanced heat exchange device of the geothermal well, the spring is a copper spring.

Preferably, in the above-mentioned downhole enhanced heat exchange device of the geothermal well, the magnetic suction piece includes a connecting rod and a magnet. One end of the connecting rod is connected with the sealing plate, and the other end of the connecting rod is provided with the magnet. The connecting rod is coaxial with the spring.

Preferably, in the above-mentioned downhole enhanced heat exchange device of the geothermal well, the first main pipe and the second main pipe are threadedly connected.

Preferably, in the above-mentioned downhole enhanced heat exchange device of the geothermal well, a position where the first main pipe is used to install the retractable heat exchange pipe is provided with a backing plate.

Preferably, in the above-mentioned downhole enhanced heat exchange device of the geothermal well, the first main pipe and the inner pipe are threadedly connected.

A single-well heat exchange system includes a single-well heat exchange device and at least one downhole enhanced heat exchange device of a geothermal well, the downhole enhanced heat exchange device of the geothermal well being the downhole enhanced heat exchange device of the geothermal well described in any one of the above solutions;

the downhole enhanced heat exchange device of the geothermal well is connected with an inner pipe of the single-well heat exchange device, and a second main pipe of the downhole enhanced heat exchange device of the geothermal well on the previous stage is connected with a first main pipe of the downhole enhanced heat exchange device of the geothermal well on the next stage.

Preferably, in the single-well heat exchange system described above, the sum of the lengths of the plurality of downhole enhanced heat exchange devices of the geothermal well is greater than or equal to the thickness of the target reservoir.

An embodiment of the present application provides a downhole enhanced heat exchange device of a geothermal well, including a first main pipe, a second main pipe and retractable heat exchange pipes. The first main pipe communicates with an inner pipe of the single-well heat exchange device, the return water entering the inner pipe enters the first main pipe and the second main pipe in sequence, part of the return water flows back directly to a geothermal reservoir, part of the return water enters an annulus between the inner pipe and an outer casing of the single-well heat exchange device through a through hole of the second main pipe. The part, located at a target reservoir, of the retractable heat exchange pipe is used for absorbing geothermal heat of the target reservoir and transmitting the geothermal heat to a fixed end of the retractable heat exchange pipe to heat the return water entering the first main pipe, so that the temperature of the return water is increased, the attenuation speed of the geothermal heat temperature of single-well heat exchange of the geothermal well is reduced, and the service life of the geothermal well is prolonged.

The present solution further discloses a single-well heat exchange system, including a single-well heat exchange device and at least one downhole enhanced heat exchange device of a geothermal well, the downhole enhanced heat exchange device of the geothermal well being the downhole enhanced heat exchange device of the geothermal well described in any one of the above solutions, since the downhole enhanced heat exchange device of the geothermal well has the above technical effects, the single-well heat exchange system having the downhole enhanced heat exchange device of the geothermal well also has the same technical effects.

BRIEF DESCRIPTION OF DRAWINGS

In order to more clearly illustrate the technical solutions in the embodiments of the present application or the prior art, the accompanying drawings which are required to be used in the description of the embodiments or the prior art will be briefly introduced below. Apparently, the drawings in the following description are merely some examples or embodiments of the present application, for those of ordinary skill in the art, without paying creative effort, other drawings can also be obtained according to the provided drawings, and the present application can also be applied to other similar scenarios according to the provided drawings. Like reference signs in the figures represent the same structure or operation unless it is obvious from the context of language or otherwise stated.

Figure 1:
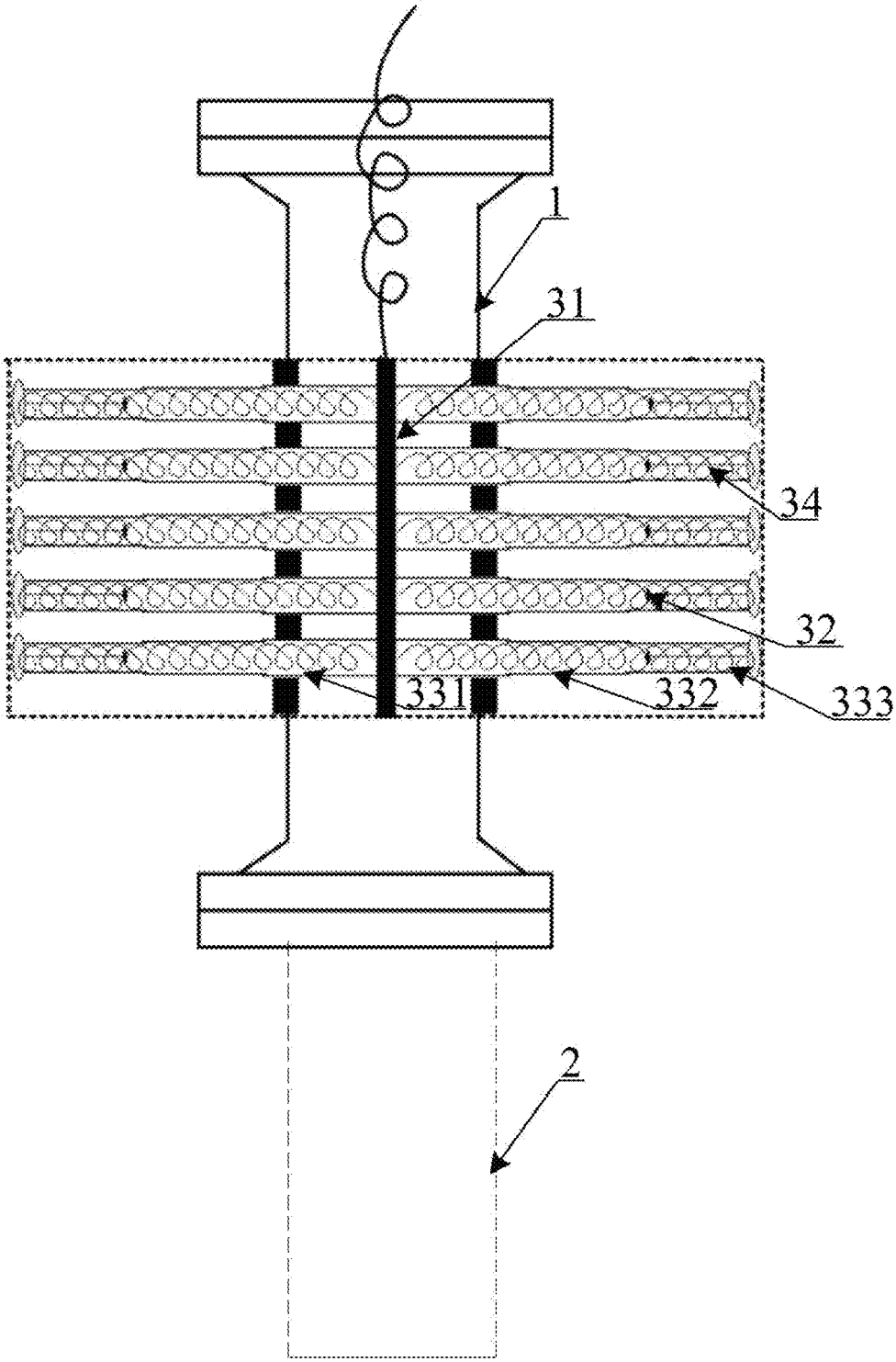
FIG. 1 is a structural schematic diagram of the retractable heat exchange pipes of the downhole enhanced heat exchange device of the geothermal well of the present application after being extended.
Figure 2:
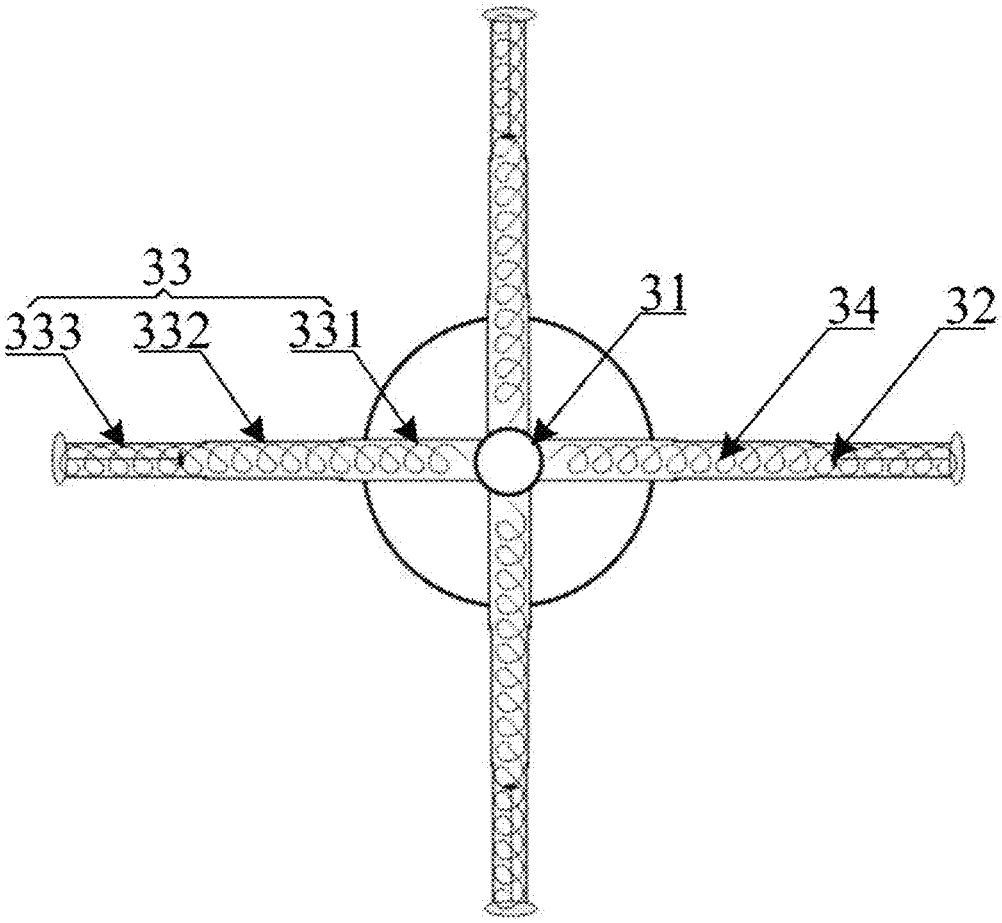
FIG. 2 is a top view of the retractable heat exchange pipes of the downhole enhanced heat exchange device of the geothermal well of the present application after being extended.
Figure 3:
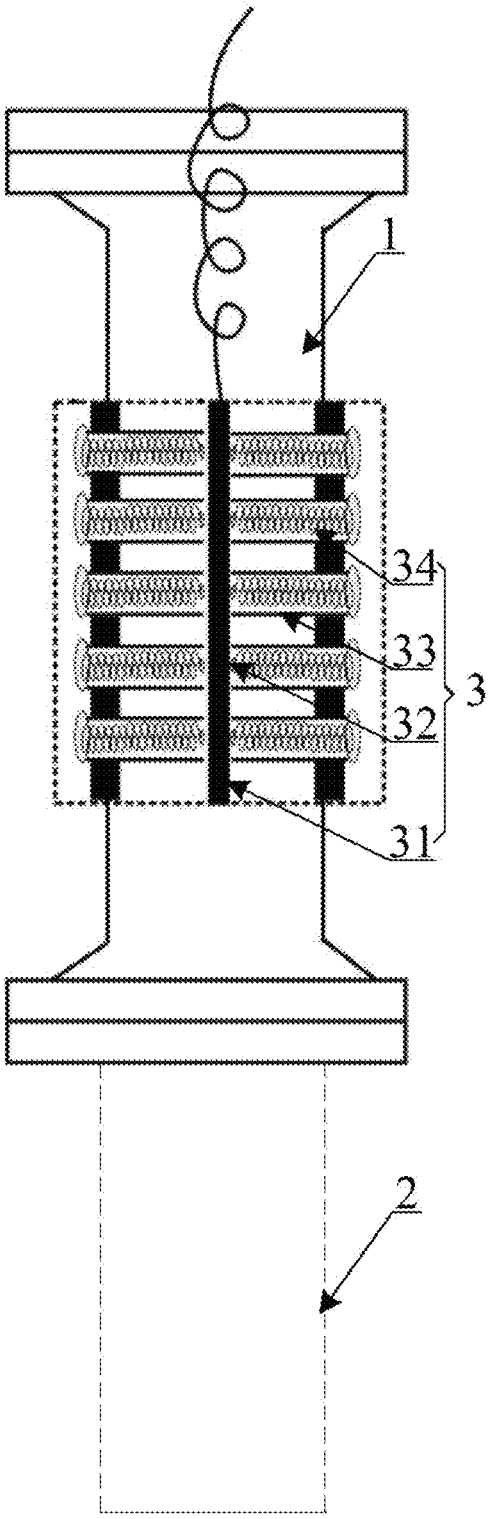
FIG. 3 is a structural schematic diagram of the retractable heat exchange pipes of the downhole enhanced heat exchange device of the geothermal well of the present application after being retracted.
Figure 4:
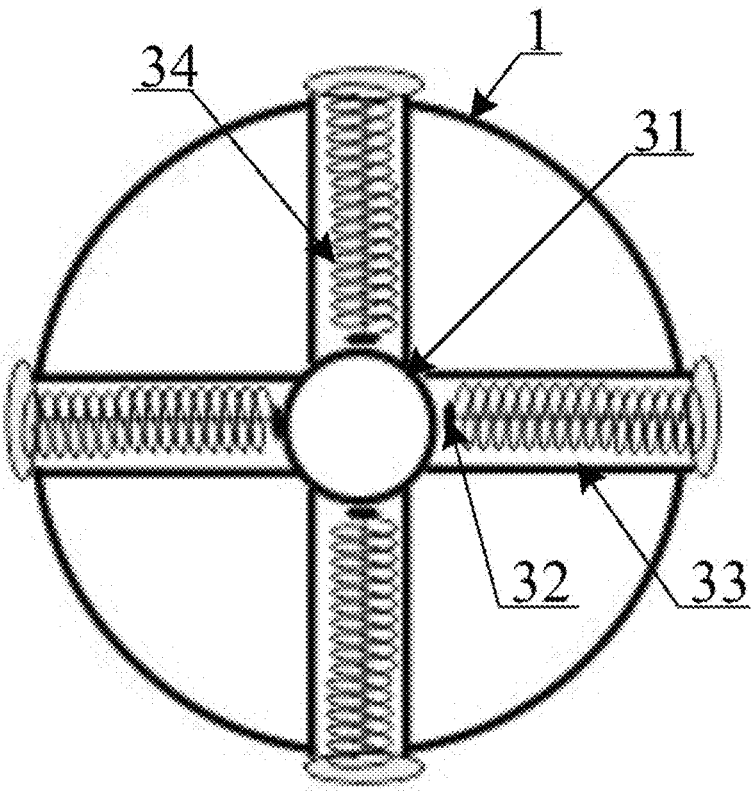
FIG. 4 is a top view of the retractable heat exchange pipes of the downhole enhanced heat exchange device of the geothermal well of the present application after being retracted.
Figure 5:
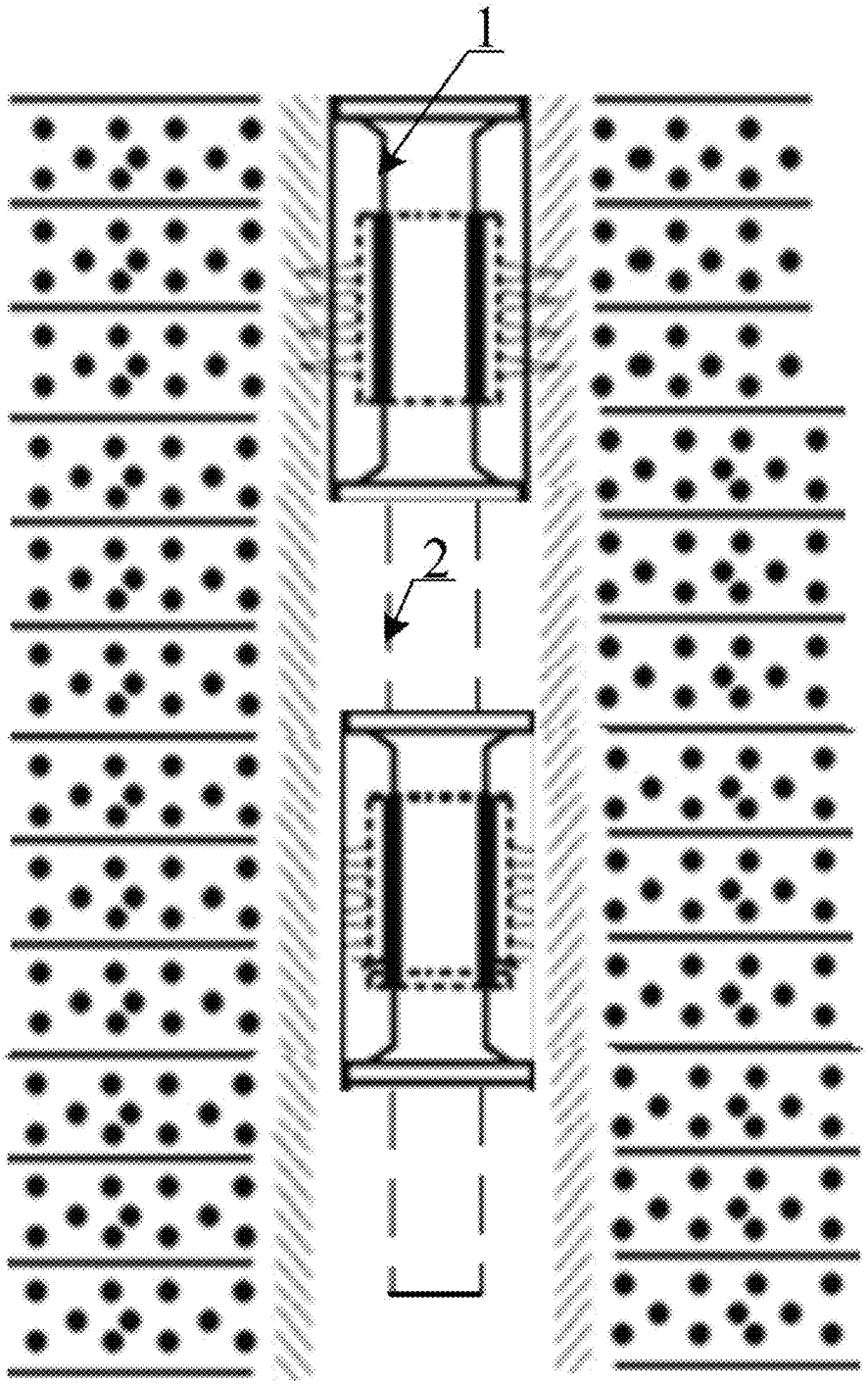
FIG. 5 is a structural schematic diagram of the connection of the adjacent downhole enhanced heat exchange devices of the geothermal well of the present application.

Wherein:

1. first main pipe, 2. second main pipe, 3. retractable heat exchange pipe, 31. electromagnet, 32. magnetic suction piece, 33. retractable pipe, 331. first short pipe, 332. second short pipe, 333. nth short pipe, 34. spring.

DETAILED DESCRIPTION OF THE EMBODIMENTS

The present application will now be described in further detail with reference to the accompanying drawings and embodiments. It should be understood that the specific embodiments described herein are merely illustrative of the related application and are not intended to be limiting. The described embodiments are only some, but not all, embodiments of the present application. Based on the embodiments in the present application, all other embodiments obtained by those of ordinary skill in the art without making inventive labor, belong to the scope of protection of the present application.

It should be noted that, for ease of description, only the parts relevant to the related application are shown in the drawings. In case of no conflict, the embodiments and the features in the embodiments in the present application may be combined with each other.

Please refer to FIGS. 1-6.

The present solution discloses a downhole enhanced heat exchange device of a geothermal well, including a first main pipe 1, a second main pipe 2 and retractable heat exchange pipes 3.

The first main pipe 1 and the second main pipe 2 are arranged in coaxial communication, an upper end of the first main pipe 1 is capable of communicating with an inner pipe of the single-well heat exchange device, a lower end of the first main pipe 1 is connected with the second main pipe 2, and the retractable heat exchange pipes 3 are installed on the first main pipe 1.

A pipe wall of the second main pipe 2 is provided with a through hole communicating with an annulus between the inner pipe and the outer casing of the single-well heat exchange device.

The first main pipe 1 communicates with the inner pipe of the single-well heat exchange device, the return water entering the inner pipe enters the first main pipe 1 and the second main pipe 2 in sequence, part of the return water flows back directly to the geothermal reservoir, part of the return water enters the annulus between the inner pipe and the outer casing of the single-well heat exchange device through the through hole of the second main pipe 2.

The number of the retractable heat exchange pipes 3 is plural, and the retractable heat exchange pipes 3 are distributed not only along the circumferential direction of the first main pipe 1 but also along the axial direction of the first main pipe 1 to maximize the contact area of the downhole enhanced heat exchange device of the geothermal well with the target reservoir.

Two ends of the retractable heat exchange pipe 3 in a retractable direction are respectively a fixed end and a free end, the fixed end of the retractable heat exchange pipe 3 is located inside the first main pipe 1 and is sealingly connected with the first main pipe 1, the free end of the retractable heat exchange pipe 3 is located outside the first main pipe 1 and is able to retract and extend along the radial direction of the first main pipe 1. After the retractable heat exchange pipe 3 is extended, the free end of the retractable heat exchange pipe 3 passes through the annulus into the target reservoir to absorb the heat of the target reservoir.

Holes in the outer casing for the extension of the retractable heat exchange pipes 3 to the reservoir are formed during cavity creation, which will be described later.

The part, located at the target reservoir, of the retractable heat exchange pipe 3 is used for absorbing the geothermal heat of the target reservoir and transmitting the geothermal heat to the fixed end of the retractable heat exchange pipe 3 to heat the return water entering the first main pipe 1, so that the temperature of the return water is increased, the attenuation speed of the geothermal heat temperature of single-well heat exchange of the geothermal well is reduced, and the service life of the geothermal well is prolonged.

Figure 6:
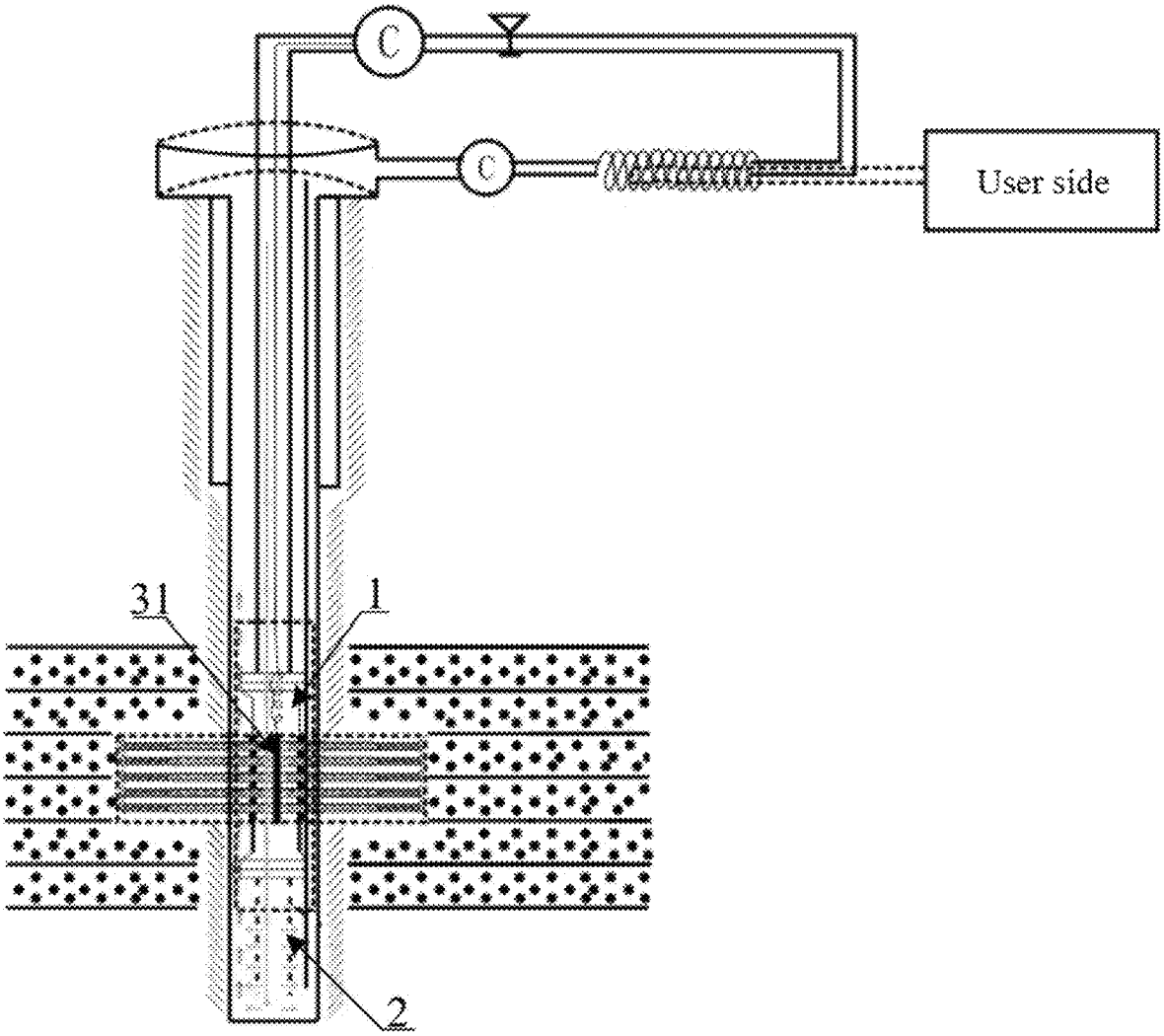
FIG. 6 is a structural schematic diagram of the single-well heat exchange device of the present application.

As shown in FIG. 6, a part of the extended retractable heat exchange pipe 3 is also located in the annulus, and the return water entering the annulus from the second main pipe 2 moves upward with the outlet water in the annulus. The retractable heat exchange pipe 3 simultaneously heats the return water exiting with the outlet water to further utilize the geothermal reservoir while ensuring the outlet water temperature.

The return water directly enters the annulus from the second main pipe 2, which reduces the use of heat from the geothermal reservoir compared to the existing technology where the return water is reheated in the geothermal reservoir, and also extends the service life of the geothermal well to a certain extent. In the present solution, the reservoir where the single-well heat exchange device extracts water is named as the geothermal reservoir, and the stratum used for heat extraction by a downhole enhanced heat exchanger of the geothermal well is named as the target reservoir.

The downhole enhanced heat exchange device of the geothermal well disclosed in the present solution is capable of utilizing the geothermal heat of the reservoir above the geothermal reservoir, and the retractable heat exchange pipe 3 extends into the reservoir in a radial direction of the inner pipe, increasing the heat exchange area between the single-well heat exchange device and the reservoir, increasing the single-well utilization efficiency, realizing efficient utilization of geothermal heat, and greatly reducing the cost of the geothermal well.

Based on the depth of the geothermal reservoir, the drilling depth and well structure are designed. After the outer casing is lowered and the well is cemented, the inner pipe is lowered. The outer wall of the inner pipe is fixed with a downhole temperature and pressure sensor, which is used for intelligent sectionalization of reservoir temperature. Combining with the previous geological exploration, the depth and scope of the high-temperature geothermal field are determined. Through downhole perforation technology, artificial dynamic cavity creation technology, etc., cavities are created at the bottom of the well. Generally, artificial dynamic cavity creation technology is used. Specifically, a specially modified drilling or completion rig is used to penetrate the geothermal reservoir. Several high-power air compressors, rotary heads, and ground duplex pipeline systems are equipped to compress a large amount of air into the well. After rapid pressure build-up and blow-out for multiple times, intense pressure kick inside the well is created, ultimately causing the target reservoir to collapse and form a cavity.

The downhole enhanced heat exchange device of the geothermal well is connected with the inner pipe, and is lowered into the target reservoir via the inner pipe. After the downhole enhanced heat exchange device of the geothermal well is lowered to the target reservoir, the retractable heat exchange pipes 3 of the downhole enhanced heat exchange device of the geothermal well are extended into the cavity to absorb the heat of the target reservoir.

In some embodiments of the present application, the retractable heat exchange pipe 3 includes an electromagnet, a magnetic suction piece 32, a retractable pipe 33 and a spring 34.

The electromagnet is located inside the first main pipe 1, and the magnetic suction piece 32 can be attracted by the electromagnet. In particular, the electromagnet is energized and the magnet suction piece 32 is attracted by the electromagnet, and the electromagnet is de-energized and the magnet suction piece 32 is not attracted by the electromagnet.

The retractable pipe 33 includes a first short pipe 331, a second short pipe 332, . . . and an nth short pipe 333 which are successively reduced in diameter and are in inserted connection, a first end of the first short pipe 331 is connected with the electromagnet, a second end of the first short pipe 331 penetrates through a pipe wall of the first inner pipe, the second end of the first short pipe 331 is connected with a first end of the second short pipe 332, and a second end of the second short pipe 332 is connected with a first end of the next short pipe, and so on, the magnetic suction piece 32 is arranged in the nth short pipe 333, wherein n is a positive integer, $n \geq 2$.

The free end of the nth short pipe 333 is provided with a sealing plate for sealing the free end of the retractable pipe 33, preventing the return water from flowing into the target reservoir through the retractable pipe 33.

The spring 34 is mounted within the retractable pipe 33, the length of the spring 34 being at least equal to the extended length of the retractable pipe 33 to ensure that the retractable pipe 33 is extended to a maximum extent under the action of the spring 34.

In the present solution, the first short pipe 331 is fixedly installed on the first main pipe 1, when the retractable heat exchange pipe 3 is extended or retracted, the first short pipe 331 is not extended or retracted, and the position of the first short pipe 331 remains unchanged. Instead, the second short pipe 332, . . . , and the nth short pipe 333 are extended or retracted.

One end of the spring 34 is connected with the electromagnet and the other end of the spring 34 is connected with the sealing plate. In order to reduce the assembly difficulty of the retractable heat exchange pipe 3, in some embodiments of the present application, the spring 34 is abutted with the electromagnet and a sealing rim.

Preferably, the electromagnet is located in the central position of the first inner pipe, the length of the first short pipe 331 is greater than the radius of the first inner pipe, but smaller than the radius of the outer casing, and the length of the nth short pipe 333 is smaller than the length of the first short pipe 331.

Before the downhole enhanced heat exchange device of the geothermal well is lowered with the inner pipe to the target reservoir, the electromagnet is energized, the magnetic suction piece 32 is attracted by the electromagnet, the spring 34 is in a compressed state, and the retractable heat exchange pipe 3 is also in a retracted state, the circumferential dimension of the downhole enhanced heat exchange device of the geothermal well is smaller than the diameter of the outer casing; after the downhole enhanced heat exchange device of the geothermal well is lowered to the target reservoir with the inner pipe, the electromagnet is de-energized, the magnetic suction piece 32 is not attracted by the electromagnet, the spring 34 is extended, and the retractable heat exchange pipe 3 is also extended by the spring 34, and the retractable heat exchange pipe 3 enters the reservoir.

Due to the high temperature of the geothermal reservoir, the retractable pipe 33 needs to have a certain high temperature resistance.

In the present embodiment, the retractable pipe 33 is made of a material having a high thermal conductivity. Preferably, the retractable pipe 33 is a copper pipe.

Preferably, after the retractable heat exchange pipes 3 are extended, the free ends of the retractable heat exchange pipes 3 can be brought into contact with the reservoir to effectively increase the heat exchange efficiency between the downhole enhanced heat exchange device of the geothermal well and the reservoir.

The spring 34 is made of copper so as not only to satisfy the strength of the spring 34 but also not to affect the thermal conductivity of the retractable heat exchange pipe 3.

The magnetic suction piece 32 may be a magnet, an electromagnet, or a ferrous piece.

In some embodiments of the present solution, the magnetic suction piece 32 is connected with the sealing plate by a connecting rod, which is located within the spring 34.

The arrangement of the connecting rod shortens the distance between the magnetic suction piece 32 and the electromagnet, reduces the difficulty of retracting the retractable heat exchange pipe 3, and improves the reliability of retracting the retractable heat exchange pipe 3.

Preferably, the length of the connecting rod does not exceed the length of the nth short pipe 333 to reduce the length of the retractable heat exchange pipe 3 after being retracted.

In order to reduce the difficulty of connecting the first main pipe 1 and the second main pipe 2 of the downhole enhanced heat exchange device of the geothermal well, the first main pipe 1 and the second main pipe 2 are threadedly connected.

In particular, the first main pipe 1 is provided with an internal/external thread, and correspondingly, the second main pipe 2 is provided with an external/internal thread cooperating with the internal/external thread of the first main pipe 1, and the first main pipe 1 and the second main pipe 2 are connected by means of internal and external threads.

In order to reduce the difficulty of connecting the downhole enhanced heat exchange device of the geothermal well to the inner pipe, the first main pipe 1 and the inner pipe are threadedly connected.

In order to guarantee the strength of the first main pipe 1, the present solution is provided with a backing plate at a position where the first main pipe 1 is used to install the retractable heat exchange pipe 3, and the backing plate is used to reinforce the strength of the first main pipe 1.

Preferably, the backing plate is welded with the first main pipe 1.

The first main pipe 1 and the second main pipe 2 are made of a corrosion resistant material.

The present solution further discloses a single-well heat exchange system, including a single-well heat exchange device and at least one downhole enhanced heat exchange device of the geothermal well, the downhole enhanced heat exchange device of the geothermal well is the downhole enhanced heat exchange device of the geothermal well described in any one of the above solutions, since the downhole enhanced heat exchange device of the geothermal well has the above technical effects, the single-well heat exchange system having the downhole enhanced heat exchange device of the geothermal well also has the same technical effects.

The single-well heat exchange device includes an inner pipe and an outer casing, the inner pipe being located within the outer casing.

In embodiments where the downhole enhanced heat exchange devices of the geothermal well are at least two, the second main pipe 2 of the downhole enhanced heat exchange device of the geothermal well on the previous stage is connected with the first main pipe 1 of the downhole enhanced heat exchange device of the geothermal well on the next stage, wherein the downhole enhanced heat exchange device of the geothermal well on the previous stage is close to the inlet with respect to the downhole enhanced heat exchange device of the geothermal well on the next stage.

The downhole enhanced heat exchange device of the geothermal well is lowered into the outer casing via the inner pipe. The overall length of the plurality of the downhole enhanced heat exchange devices of the geothermal well is greater than or equal to the thickness of the target reservoir.

Based on the depth of the geothermal reservoir, the drilling depth and well structure are designed. After the outer casing is lowered and the well is cemented, the inner pipe is lowered. The outer wall of the inner pipe is fixed with a downhole temperature and pressure sensor, which is used for intelligent sectionalization of reservoir temperature. Combining with the previous geological exploration, the depth and scope of the high-temperature geothermal field are determined. Through downhole perforation technology, artificial dynamic cavity creation technology, etc., cavities are created at the bottom of the well. Generally, artificial dynamic cavity creation technology is used. Specifically, a specially modified drilling or completion rig is used to penetrate the geothermal reservoir. Several high-power air compressors, rotary heads, and ground duplex pipeline systems are equipped to compress a large amount of air into the well. After rapid pressure build-up and blow-out for multiple times, intense pressure kick inside the well is created, ultimately causing the target reservoir to collapse and form a cavity.

The downhole enhanced heat exchange device of the geothermal well is lowered into the cavity of the target reservoir, and a plurality of the downhole enhanced heat exchange devices of the geothermal well are assembled based on the thickness of the target reservoir, so that the overall length of the plurality of the downhole enhanced heat exchange devices of the geothermal well is greater than or equal to the thickness of the target reservoir.

The present solution changes the contact area between the downhole enhanced heat exchange device of the geothermal well and the target reservoir by adjusting the length of the spring 34 and the length of the cavity, increasing the heat exchange area according to needs.

By creating cavities in different stages and cooperating with the downhole enhanced heat exchange devices of the geothermal well, the present solution greatly enhances the heat exchange area of the single-well heat exchange system, ultimately achieving efficient utilization of geothermal energy.

The single-well heat exchange device includes an inner pipe, an outer casing, a water pump, a high-efficiency heat exchanger, an injection pump, and a stop valve.

During the exploitation of geothermal energy, the stop valve is opened, and the water pump extracts the geothermal water from the annulus, sending it to the high-efficiency heat exchanger to provide thermal energy to the user side. An outlet of the high-efficiency heat exchanger is connected to the injection pump for reinjection of the heat-exchanged water.

The injection pump pressurizes and reinjects the circulating geothermal water. During the injection process, the injection pressure is controlled between 20 MPa and 25 MPa, with the maximum pressure less than 30 MPa, and the injection volume of the circulating geothermal water is also controlled. In cases where the ground pressure is insufficient, a fracturing pump truck can be used to ensure that the maximum injection displacement exceeds 20 $m^3$/min.

In the early stage of cyclical geothermal water injection, if the return water of the single-well heat exchange device is greater than the outlet water, it reflects that the target reservoir is poorly fractured, and the downhole enhanced heat exchange device of the geothermal well needs to be taken out for re-fracturing, and if the return water of the single-well heat exchange device is less than the outlet water, it reflects that the target reservoir is well fractured.

After the retractable heat exchange pipe 3 of the downhole enhanced heat exchange device of the geothermal well is extended, a part of the retractable heat exchange pipe 3 is located inside the first main pipe 1, a part is located in the annulus, and another part is located in the target reservoir.

The part of the retractable heat exchange pipe 3 located in the target reservoir is capable of absorbing heat from the geothermal reservoir and transferring the heat to the part of the retractable heat exchange pipe 3 located in the annulus and the first main pipe 1.

The part of the retractable heat exchange pipe 3 located inside the first main pipe 1 is capable of heating the return water entering the first main pipe 1, and part of the heated return water enters the geothermal reservoir, and another part enters the annulus through the through hole of the second main pipe 2, moves upward with the outlet water of the annulus, is heated by the part of the retractable heat exchange pipe 3 located inside the annulus, and is finally discharged with the outlet water.

A plurality of downhole enhanced heat exchange devices of a geothermal well are provided along the thickness direction of the target reservoir, which can heat the return water for multiple times, increase the return water temperature of the geothermal well, and achieve efficient utilization of thermal energy.

The downhole enhanced heat exchange device of the geothermal well disclosed herein can achieve different downhole heat exchange areas according to the horizontal spread of the target reservoir by varying the length of the spring 34 and the artificial dynamic cavity creation length.

The above description is only an explanation of the preferred embodiment of the present application and the technical principles used, and is not intended to limit the present application. For those skilled in the art, the present application may be subject to various modifications and variations. The scope of application involved in the present application is not limited to technical solutions formed by a specific combination of the above-mentioned technical features, but should also cover other technical solutions formed any combination of the above-mentioned technical features or their equivalent features without departing from the above-mentioned application concept. For example, the above-described features may be substituted with features disclosed in the present application (but not limited to) having similar functions.

What is claimed is:

1. A downhole enhanced heat exchange device of a geothermal well, comprising:

a first main pipe (1), an upper end of the first main pipe (1) being able to communicate with an inner pipe of a single-well heat exchange device;

a second main pipe (2) communicating with a lower end of the first main pipe (1), a pipe wall of the second main pipe (2) being provided with a through hole communicating with an annulus between the inner pipe and an outer casing of the single-well heat exchange device; and retractable heat exchange pipes (3), the retractable heat exchange pipes (3) being able to extend and retract along the radial direction of the first main pipe (1), a fixed end of the retractable heat exchange pipe (3) being located in the first main pipe (1) and sealingly connected with the first main pipe (1), and a free end of the retractable heat exchange pipe (3) being able to extend into a target reservoir by the annulus to absorb the heat of the target reservoir for heating return water of the inner pipe.

2. The downhole enhanced heat exchange device of a geothermal well according to claim 1, wherein the retractable heat exchange pipe (3) comprises:

an electromagnet, located in the first main pipe (1);

a magnetic suction piece (32) capable of being absorbed by the electromagnet;

a retractable pipe (33), comprising a first short pipe (331), a second short pipe (332), . . . and an nth short pipe (333) which are successively reduced in diameter and are in inserted connection, a first end of the first short pipe (331) is connected with the electromagnet, a second end of the first short pipe (331) penetrates through a pipe wall of the first inner pipe and is connected with the pipe wall, a free end of the nth short pipe (333) is provided with a sealing plate, the magnetic suction piece (32) is arranged in the nth short pipe (333), and the magnetic suction piece (32) is connected with the sealing plate, wherein n is a positive integer, $n \geq 2$; and a spring (34), installed inside the retractable pipe (33), the spring (34) having a length at least equal to the extended length of the retractable pipe (33), one end of the spring (34) being connected with the electromagnet, the other end of the spring (34) being connected with the sealing plate.

3. The downhole enhanced heat exchange device of a geothermal well according to claim 2, wherein the retractable pipe (33) is a copper pipe.

4. The downhole enhanced heat exchange device of a geothermal well according to claim 2, wherein the spring (34) is a copper spring.

5. The downhole enhanced heat exchange device of a geothermal well according to claim 2, wherein the magnetic suction piece (32) is a magnet, an electromagnet or a ferrous piece; and/or, the magnetic suction piece (32) is connected with the sealing plate by a connecting rod, the connecting rod being located within the spring (34).

6. The downhole enhanced heat exchange device of a geothermal well according to claim 1, wherein the first main pipe (1) and the second main pipe (2) are threadedly connected.

7. The downhole enhanced heat exchange device of a geothermal well according to claim 1, wherein a position where the first main pipe (1) is used to install the retractable heat exchange pipe (3) is provided with a backing plate.

8. The downhole enhanced heat exchange device of a geothermal well according to claim 1, wherein the first main pipe (1) and the inner pipe are threadedly connected.

9. A single-well heat exchange system, comprising a single-well heat exchange device and at least one downhole enhanced heat exchange device of a geothermal well, the downhole enhanced heat exchange device of the geothermal well being the downhole enhanced heat exchange device of the geothermal well according to claim 1; and the downhole enhanced heat exchange device of the geothermal well is connected with an inner pipe of the single-well heat exchange device, and a second main pipe (2) of the downhole enhanced heat exchange device of the geothermal well on the previous stage is connected with a first main pipe (1) of the downhole enhanced heat exchange device of the geothermal well on the next stage.

10. The single-well heat exchange system according to claim 9, wherein the sum of the lengths of the plurality of downhole enhanced heat exchange devices of the geothermal well is greater than or equal to the thickness of the target reservoir.

* * * * *